United States Patent [19]

Poulo

[11] 4,218,583

[45] Aug. 19, 1980

[54] VARYING LOUDSPEAKER SPATIAL CHARACTERISTICS

[75] Inventor: Louis R. Poulo, Wayland, Mass.

[73] Assignee: Bose Corporation, Framingham, Mass.

[21] Appl. No.: 929,179

[22] Filed: Jul. 28, 1978

[51] Int. Cl.[2] ..... H04R 1/02; H04R 5/00

[52] U.S. Cl. ..... 179/1 E; 179/1 D; 179/1 GA

[58] Field of Search ..... 179/1 G, 1 D, 1 E, 1 GA; 181/144

[56] References Cited

U.S. PATENT DOCUMENTS

| | | | |
|---|---|---|---|
| 1,931,235 | 10/1933 | Nicolson | 179/1 D |
| 3,582,553 | 6/1971 | Bose | 179/1 E |

FOREIGN PATENT DOCUMENTS

| | | | |
|---|---|---|---|
| 1108268 | 1/1961 | Fed. Rep. of Germany | 179/1 D |
| 2604954 | 8/1977 | Fed. Rep. of Germany | 179/1 D |

*Primary Examiner*—Douglas W. Olms
*Attorney, Agent, or Firm*—Charles Hieken

[57] ABSTRACT

A loudspeaker system having two angled rear panels with four drivers on each rear panel and a single driver on the front panel has the drivers connected in series between first and second terminals and a third terminal connected to the junction of the front driver and one of the banks of series-connected rear drivers. First and second power amplifiers are connected between the third terminal and the first and second terminals, respectively. A potentiometer is connected between the inputs of the first and second power amplifiers with the potentiometer arm coupled to the third terminal through a capacitor.

17 Claims, 6 Drawing Figures

VARYING LOUDSPEAKER SPATIAL CHARACTERISTICS

BACKGROUND OF THE INVENTION

The present invention relates in general to varying spatial characteristics and more particularly concerns novel apparatus and techniques for varying the spatial characteristics of a loudspeaker such as the BOSE 901 Series III loudspeaker which radiates predominantly more sound energy upon a reflecting surface first and then into a listening area than it radiates directly into the listening area to enable the listener to control the apparent sound image, thereby enhancing the listening experience with structure that is relatively free from complexity and easy to control.

The BOSE 901 loudspeaker system embodies the invention patented in U.S. Pat. No. 3,582,553 and has met with wide critical and consumer acclaim throughout the world, receiving an unprecedented series of rave reviews. The 901 system includes a pair of adjacent rear-facing angled panels filled with like in-phase-connected loudspeaker drivers operative over the full frequency range for radiating sound energy first upon a reflecting surface and then into the listening area with a single driver on the front panel for radiating significantly less sound energy directly into the listening area. An associated active equalizer coacts with the loudspeakers to provide a system characterized by a substantially uniform radiated power response as a function of frequency over substantially the entire audio frequency range.

This system simulates the sound received in a concert hall where the listener receives significantly more reflected energy than direct energy from the sound source on the stage. The listener perceives the relatively broad sound image as if the sound source originated from across the entire surface of the wall adjacent to the loudspeaker cabinets. Alteration of the sound energy may be effected by altering the angle between the panels and the adjacent wall. For example, the perceived image may be moved closer to the center by rotating the cabinet so that the angle between the outside rear panels and the facing wall is reduced while that between the inside rear panels and the facing wall is increased. Conversely, increasing the latter and reducing the former tends to move the perceived image further outward. While this physical movement provides some control of perceived image, it is impractical in many situations where the listener may want to alter the perceived image from selection to selection, especially where the loudspeakers are suspended from the ceiling. Furthermore, the degree of image alteration is somewhat limited.

Accordingly, it is an important object of this invention to provide improved methods and means for varying spatial characteristics of a loudspeaker by electrical means.

It is a further object of the invention to achieve the preceding object with a loudspeaker of the type of a BOSE 901 loudspeaker system.

It is a further object of the invention to achieve one or more of the preceding objects over a relatively wide range and with a single control that is easy to operate by a technically unskilled listener.

It is still a further object of the invention to achieve one or more of the preceding objects without altering the volume.

It is still a further object of the invention to achieve one or more of the preceding objects with the addition of relatively little additional apparatus that is reliable and relatively inexpensive.

SUMMARY OF THE INVENTION

According to the invention, there are first and second upper frequency loudspeaker driving means for radiating upper frequency sound energy having spectral components above a predetermined upper frequency above the low frequency range, such as 200 Hz toward first and second opposed sides, respectively, connected in series between first and second input terminals with a third terminal connected to a junction between said first and second loudspeaker driver means, means for coupling a potentiometer between the first and second terminals, and means for coupling the arm of the potentiometer to the third terminal. Preferably, the means for coupling the potentiometer to the first and second terminals comprises first and second power amplifying means for delivering electrical energy to the first and second power amplifying means for delivering electrical energy to the first and second upper frequency radiating means, respectively. Preferably the means for coupling the potentiometer arm to the third terminal comprises capacitive means for attenuating D.C. and lower frequency signals.

Numerous other features, objects and advantages of the invention will become apparent from the following specification when read in connection with the accompanying drawing in which:

DETAILED DESCRIPTION OF PREFERRED EMBODIMENTS

Figure 1:
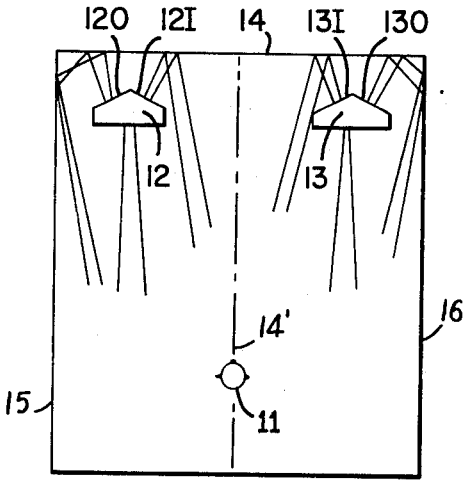
FIGS. 1–3 are plan diagrammatic views illustrating energy paths for normal, predominantly outside and predominantly inside perceived images, respectively, of a system adjusted according to the invention.

With reference now to the drawing and more particularly FIG. 1 thereof, there is shown a plan diagrammatic representation of a room having a listener 11 and left and right loudspeakers 12 and 13, respectively, for reproducing left and right stereo channels, respectively. The loudspeakers 12 and 13 are typically commercially available BOSE 901 Series III cabinets. As represented in FIG. 1 substantially the same sound energy is radiated from the inside panels 12I and 13I as is radiated from the outside panels 12O and 13O. Listener 11 then perceives the resultant sound image as substantially uniformly distributed across rear wall 14.

Figure 2:
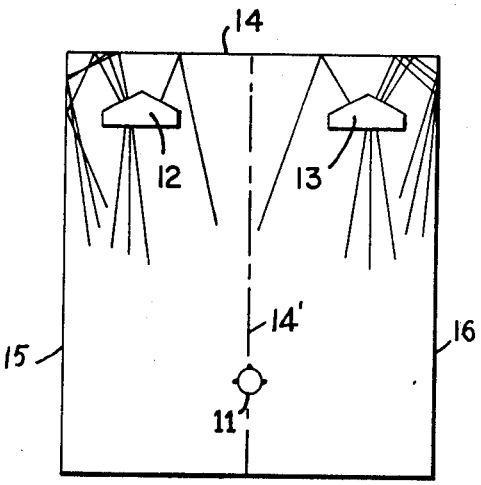

Referring to FIG. 2, there is shown a plan diagrammatic representation wherein loudspeakers 12 and 13 radiate more energy from outside panels 12O and 13O than from inside panels 12I and 13I so that listener 11 perceives a broader sound image with significant portions of the sound appearing to originate to the outside of loudspeakers 12 and 13 near side walls 15 and 16.

Figure 3:
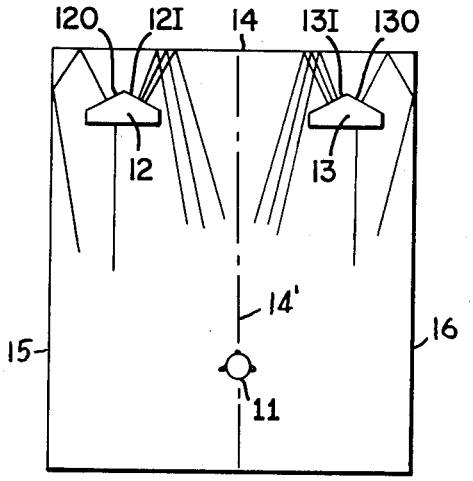

Referring to FIG. 3, there is shown a plan diagrammatic representation of a system according to the invention arranged to radiate more sound energy toward centerline 14' that is perpendicular to rear wall 14 than to the outside near side walls 15 and 16 so that listener 11 perceives a sound image located more toward the center of wall 14, a desirable representation for certain types of music, such as a solo performance. The inside of the listening area is that between loudspeakers 12 and 13 and centerline 14', and the outside of the listening area is that between loudspeakers 12 and 13 and side walls 15 and 16, respectively.

Figure 4:
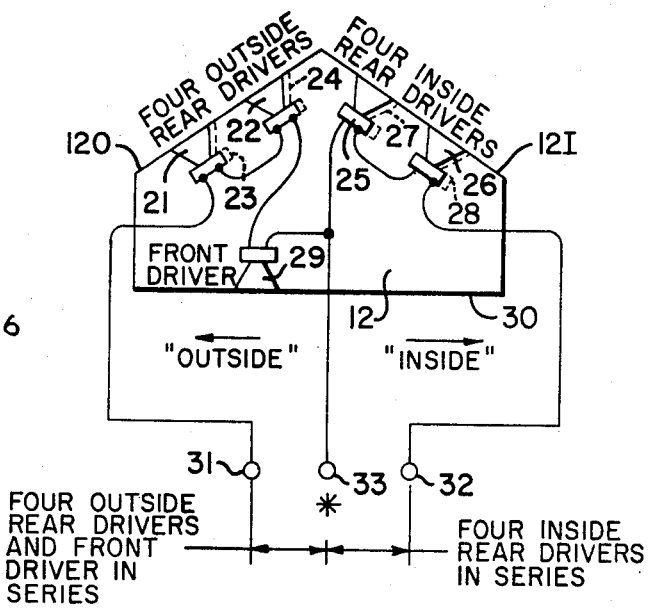
FIG. 4 is a diagrammatic representation of the terminal interconnections according to the invention.

Referring to FIG. 4, there is shown a diagrammatic representation of the preferred form of driver interconnection according to the invention. Outside panel 12O carries 4 drivers 21–24, inside panel 12I carries 4 drivers 25–28 and front panel 30 carries a single front driver 29. Drivers 21–29 are connected in series with front driver 29 connected in series between drivers 21–24 and inside drivers 25–28. The nine drivers are connected in series between outside terminal 31 and inside terminal 32 with the junction of front driver 29 and inside rear driver 25 connected to center terminal 33.

Figure 5:
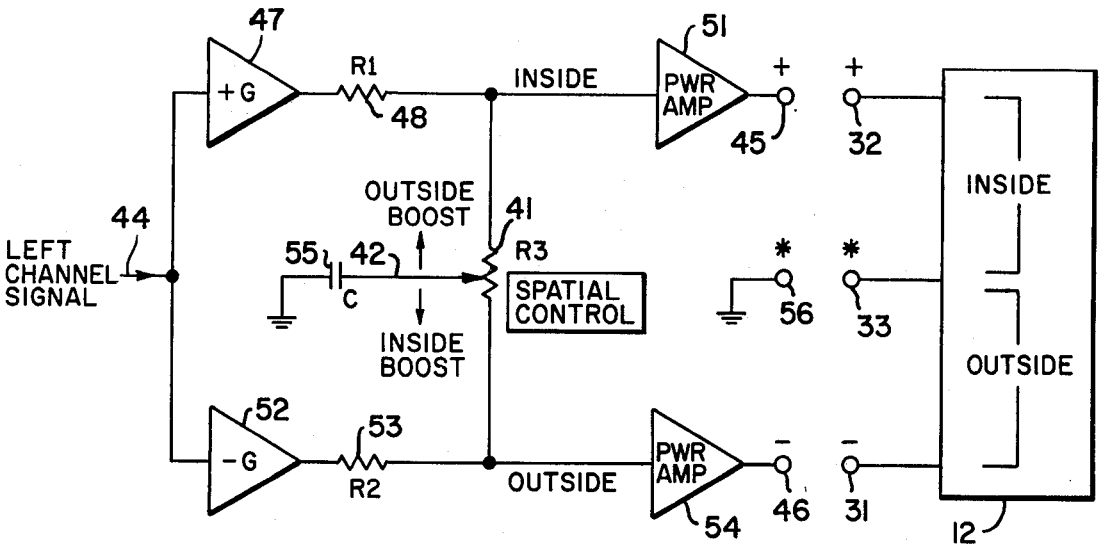
FIG. 5 is a combined block-schematic circuit diagram of a system according to the invention.

Referring to FIG. 5, there is shown a combined block-schematic circuit diagram of a preferred embodiment of the invention having a spatial control combined with the filtering so that the spatial control 41 is effective at the upper frequencies typically above 300 Hz while negligibly affecting the lower frequency spectral components so that all the drivers receive substantially the same energy below 300 Hz where radiated sound is largely nondirectional. Spatial control 41 controls the ratio of inside radiated sound to outside radiated sound in accordance with the position of arm 42 for spectral components above a predetermined upper frequency while the total power response of the system remains essentially unchanged; that is, the radiated power response as a function of frequency is substantially uniform independently of the position of arm 42 of spatial control 41.

A left channel signal on input 44 is amplified and provided on + and − output terminals 45 and 46, respectively, with low frequency components of substantially the same amplitude but of opposite phase. To this end the left channel signal on input 44 is applied to an inside channel comprising amplifier 47, resistor 48 of value R1 and power amplifier 51 and to an outside channel comprising amplifier 52, resistor 53 of value R2 and power amplifier 54, the gains of amplifiers 47 and 52 being of equal magnitude and opposite sense to provide the desired phase reversal.

Capacitor 55 of value C couples the arm 42 of potentiometer 31 of resistance R3 to ground. Center terminal 33 of loudspeaker system 12 is connected to ground through terminal 56.

Figure 6:
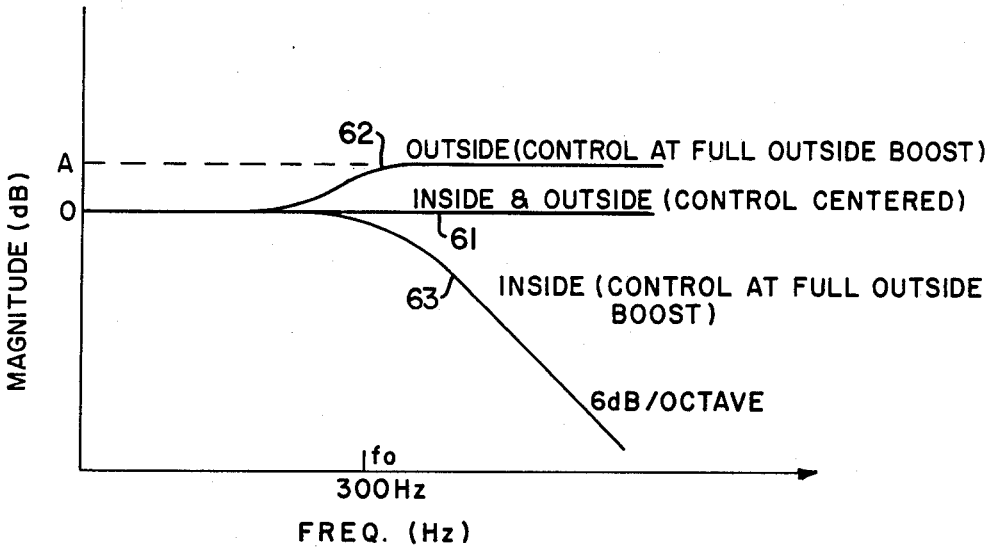
FIG. 6 is a graphical representation of the transfer function to inside and outside banks of drivers for center and extreme spatial control settings.

Referring to FIG. 6, there are shown the frequency response characteristics of the inside and outside banks of drivers with potentiometer arm 42 centered and at maximum outside boost. Curve 61 shows the responses are both substantially uniform with arm 42 centered. Curve 62 shows the boost in response of the outside bank while curve 63 shows the drop in response of the inside bank of drivers. Responses 63 and 62 are reversed when arm 42 is moved to the maximum inside boost position.

By choosing the maximum gain A to be approximately 3 dB, the total output from an enclosure at any frequency is approximately constant as the position of arm 42 is varied to produce only a perceived image change without audible change in volume. A typical half power or hinge frequency is of the order of 300 Hz and is determined substantially by resistances R1 and R2, typically equal, R3, and capacitance C. Typical values for resistance R1 and R2 are 2.7 Kohms, for potentiometer R3 5 Kohms and for capacitance C 0.22 microfarads to produce a hinge frequency (3 db down) of the order of 250 Hz at maximum cut.

The invention has a number of advantages. A listener may easily control the nature of the perceived image by operating control 41 without altering the volume. The desired substantially uniform radiated power response is retained as perceived image is altered. At low frequencies where most power is required, all the drivers are energized substantially equally to enhance the ability of the system to produce high sound levels without audible distortion and without affecting the ability to selectively alter the perceived image.

The perceived image control may be disabled by opening the connection to potentiometer arm 42. It may be converted to a full range flat frequency response balance control between inside and outside outputs 45 and 46 by shorting capacitor 55. This feature is useful when separate enclosures or speaker systems are connected to inside and outside outputs 45 and 46, respectively, so that the control may function as a full-range balance control.

It is within the principles of the invention to drive the different sections of the loudspeaker enclosure with more complex systems, such as using higher order sections, delay networks and nonlinear processing.

The invention is immediately useable in connection with the BOSE 901 Series III loudspeaker already having the three terminals. The invention is also adaptable for use with the commercially available BOSE 501 and 601 loudspeakers. The commercially available 501 loudspeaker has a woofer, an inside firing tweeter and an outside firing tweeter. The woofer is connected across the inside and outside terminals. The inside tweeter and a capacitor comprising the crossover network is connected between the inside terminal and the intermediate terminal. The outside tweeter and a capacitor comprising the crossover network is connected in series between the outside terminal and the intermediate terminal. The capacitors are preferably substantially equal and have a capacitance substantially twice that of the capacitance in the crossover network associated with a 501 system having two input terminals.

The 601 loudspeaker system has two woofers, a pair of inside firing tweeters and a pair of outside firing tweeters. The two woofers are connected in parallel between the inside and outside terminals. The inside tweeters may be connected in series or parallel between the inside terminal and a capacitor comprising a crossover network connected to the intermediate terminal. The outside tweeters may be connected in series or parallel between the outside terminal and a capacitor comprising the crossover network connected to the intermediate terminal. Since in these commerical embodiments the low frequency cutoff of the tweeters is much higher than that of the full-range drivers in the BOSE 901 loudspeakers, the image control is less noticeable than with the BOSE 901 loudspeaker system. The techniques described using woofer-tweeter combinations will provide improved spatial control with tweeters having a significant output in the region extending down to between 250 and 500 Hz.

It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Apparatus for controlling the perceived image of a sound signal radiated by a loudspeaker system comprising, a first set of first and second upper frequency loudspeaker driver means for radiating upper frequency sound energy toward first and second areas respectively beside opposed sides of said first set, first loudspeaker enclosure means for supporting said first set of loudspeaker driver means having first terminal means coupled to said first set of loudspeaker driver means for receiving an amplified first audio electrical signal, said first loudspeaker enclosure means having a front panel that faces a listening area when normally positioned in a room and having other panels, most of said first driver means and most of said second driver means having their axes angled to said front panel so that each of said first and second driver means radiates significantly more energy to said first and second areas respectively than either radiates outward from said front panel in a direction perpendicular thereto directly into the listening area, image control potentiometer means for controlling the ratio of upper frequency sound energy radiated by said first driver means relative to that radiated by said second driver means to affect said perceived sound image, a first input for receiving a first electrical signal representative of a first sound signal emanating from a first direction associated with at least a second sound signal emanating from a second direction different from said first direction, and means including said image control potentiometer means for coupling said first input to said first terminal means whereby adjustment of said image control potentiometer means affects said perceived image.

2. Apparatus for controlling the perceived image of a sound signal in accordance with claim 1 and further comprising, a second set of said first and second upper frequency loudspeaker driver means for radiating upper frequency sound energy toward third and fourth areas respectively beside opposed sides of said second set, second loudspeaker enclosure means for supporting said second set of loudspeaker driver means having second terminal means coupled to said second set of loudspeaker driver means for receiving an amplified second audio electrical signal, said second loudspeaker enclosure means having a front panel that faces said listening area when normally positioned in a room and having other panels, most of said first driver means and most of said second driver means having their axes angled to said front panel so that each of said first and second driver means radiates significantly more energy to said third and fourth areas respectively than either radiates outward from said front panel in a direction perpendicular thereto directly into the listening area, a second intput for receiving a second electrical signal representative of said second sound signal, and means including said image control potentiometer means for coupling said second input to said second terminal means whereby adjustment of said image control potentiometer means affects said perceived image by controlling the ratio of upper frequency sound energy radiated by said first driver means relative to that radiated by said second driver means.

3. Apparatus for controlling the perceived image of a sound signal in accordance with claim 1 wherein said first terminal means comprises inside, outside and intermediate terminals and further comprising, means for connecting said first loudspeaker driver means and said second loudspeaker driver means in series between said inside and said outside terminals, means for connecting the junction of said first and second loudspeaker driver means to said intermediate terminal, said potentiometer means having a movable arm whereby the signal level developed between said arm and each end of said potentiometer means is related to the position of the said arm, means for coupling said potentiometer means between said inside and outside terminals, and means for coupling said potentiometer arm to said intermediate terminal.

4. Apparatus for controlling the perceived image in accordance with claim 3 wherein said means for coupling said potentiometer arm to said intermediate terminal comprises capacitive means for selectively attenuating spectral components below a predetermined low audio frequency.

5. Apparatus for controlling the perceived image in accordance with claim 4 wherein said means for coupling said potentiometer means between said inside and outside terminals comprises inside and outside power amplifying means respectively for amplifying inside and outside signals respectively.

6. Apparatus for controlling the perceived image in accordance with claim 5 and further comprising, inside and outside amplifying means for coupling said first input to said inside and outside power amplifying means respectively, said amplifying means and said power amplifying means coacting to establish at the outputs of said power amplifying means signals of substantially equal magnitude but opposite phase for spectral components below said predetermined low frequency when said potentiometer arm is at a predetermined intermediate point of said image control potentiometer means.

7. Apparatus for controlling the perceived sound image in accordance with claim 1 wherein said loudspeaker enclosure means comprises angled adjacent first and second panels supporting said first and second loudspeaker driver means respectively, said loudspeaker driver means comprising a plurality of closely spaced in-phase-connected full-range loudspeakers.

8. Apparatus for controlling the perceived sound image in accordance with claim 7 wherein each of said panels carries four closely spaced full-range loudspeakers.

9. Apparatus for controlling the perceived sound image in accordance with claim 7 wherein said second loudspeaker driver means comprises a full-range loudspeaker on a front panel of said enclosure means.

10. Apparatus for controlling the perceived sound image in accordance with claim 8 wherein said second loudspeaker driver means comprises a full-range loudspeaker on a front panel of said enclosure means.

11. Apparatus for controlling the perceived image of a sound signal in accordance with claim 1 and further including means for maintaining the total output radiated by said first and second loudspeaker driver means at any audio frequency substantially constant as said image control potentiometer means is adjusted to produce only a perceived image change without audible change in volume.

12. Apparatus for controlling the perceived image of a sound signal in accordance with claim 11 and further comprising means for establishing the radiated power response of said set substantially uniform as the perceived image is altered by varying said image control potentiometer means.

13. Apparatus for controlling the perceived image of a sound signal in accordance with claim 11 and further comprising means including first and second power amplifying means for coupling said image control potentiometer means to said first and second upper frequency loudspeaker driver means respectively.

14. Apparatus for controlling the perceived image of a sound signal in accordance with claim 13 and further comprising, first and second amplifying means for coupling said first input to said first and second power amplifying means respectively, said image control potentiometer means having a movable arm, capacitive means coupled to said movable arm for selectively attenuating spectral components below a predetermined low audio frequency, said amplifying means and said power amplifying means coacting to establish at the outputs of said power amplifying means signals of substantially equal magnitude but opposite phase for spectral components below said predetermined low frequency when said movable arm is at a predetermined intermediate point of said image control potentiometer means.

15. Apparatus for controlling the perceived image of a sound signal in accordance with claim 14 and further comprising means including said image control potentiometer means, first and second resistive means in series with said first and second amplifying means and said capacitive means for establishing said predetermined low audio frequency.

16. Apparatus for controlling the perceived image of a sound signal in accordance with claim 15 wherein said first and second resistive means establish a half power frequency of the order of 250–300 Hz.

17. Apparatus for controlling the perceived image of a sound signal in accordance with claim 2 and means including said image control potentiometer means for selectively providing asymmetrical radiation from each of said first and second sets while the combined radiation therefrom remains symmetrical to selectively vary said perceived image while the perceived sound volume remains substantially constant.

* * * * *